US006983965B1

(12) United States Patent
Bergell

(10) Patent No.: US 6,983,965 B1
(45) Date of Patent: Jan. 10, 2006

(54) LEAF COLLECTING SYSTEM

(76) Inventor: Aaron Bergell, 7835 Ontario Street Cir., Sarasota, FL (US) 34243

( * ) Notice: Subject to any disclaimer, the term of this patent is extended or adjusted under 35 U.S.C. 154(b) by 0 days.

(21) Appl. No.: 10/867,371

(22) Filed: Jun. 14, 2004

(51) Int. Cl.
*B65D 67/12* (2006.01)

(52) U.S. Cl. ..... 294/1.1; 15/257.1; 141/390; 141/391

(58) Field of Classification Search ..... 294/1.1, 294/55; 15/257.1, 257.3; 248/95, 97, 99; 141/108, 390, 391
See application file for complete search history.

(56) References Cited

U.S. PATENT DOCUMENTS 4,749,011 A * 6/1988 Rylander ..... 141/316
4,760,982 A * 8/1988 Cooke ..... 248/99
5,129,609 A * 7/1992 Tobin ..... 248/97
5,205,107 A * 4/1993 Herink ..... 53/255
5,271,589 A * 12/1993 Belous ..... 248/97
6,708,742 B2 * 3/2004 Weathers et al. ..... 141/391

* cited by examiner

*Primary Examiner*—Dean J. Kramer
(74) *Attorney, Agent, or Firm*—Edward P. Dutkiewicz

(57) ABSTRACT

A chute is fabricated of a resilient, generally rigid material. The chute has a central section and two side sections coupled to the central section. The central section and each side section have input edges, output edges and side edges there between. Each side section has a cut out extending from its output edge toward its input edge. The cut out extends inwardly from its exterior edge. The chute is adapted to be held in an open orientation. The side sections are in a spaced configuration. The input ends and L-shaped cut outs within a trash container and the remainder of the chute extend outwardly from the trash container. In this manner a user may sweep leaves and other debris onto the central section of the chute between the side sections and into the trash container.

2 Claims, 3 Drawing Sheets

FIG 3
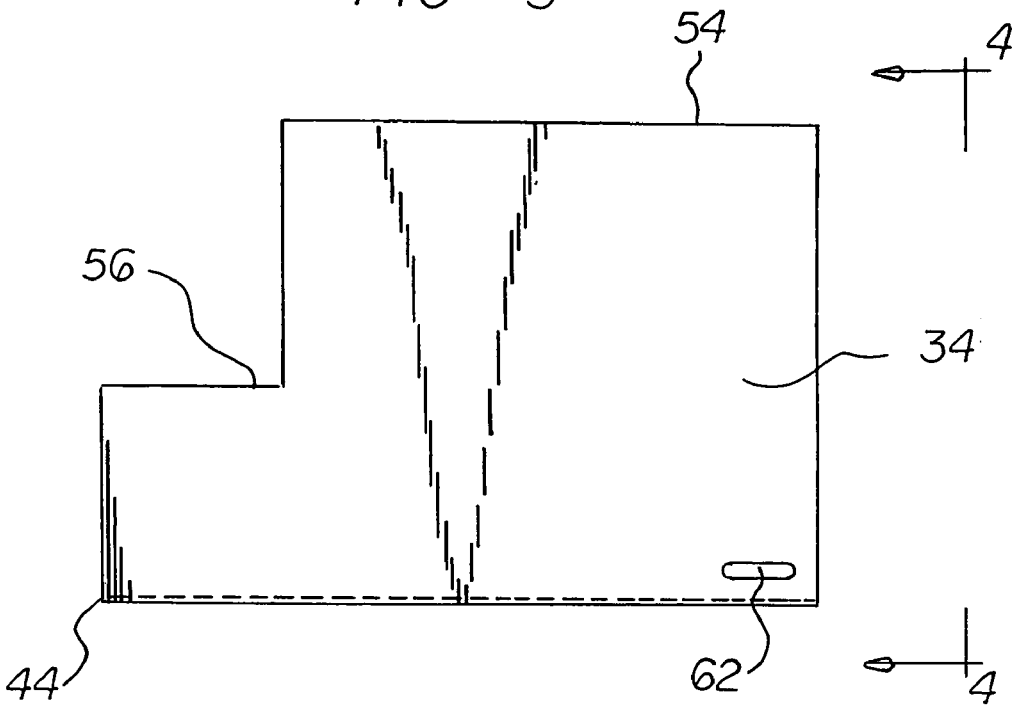
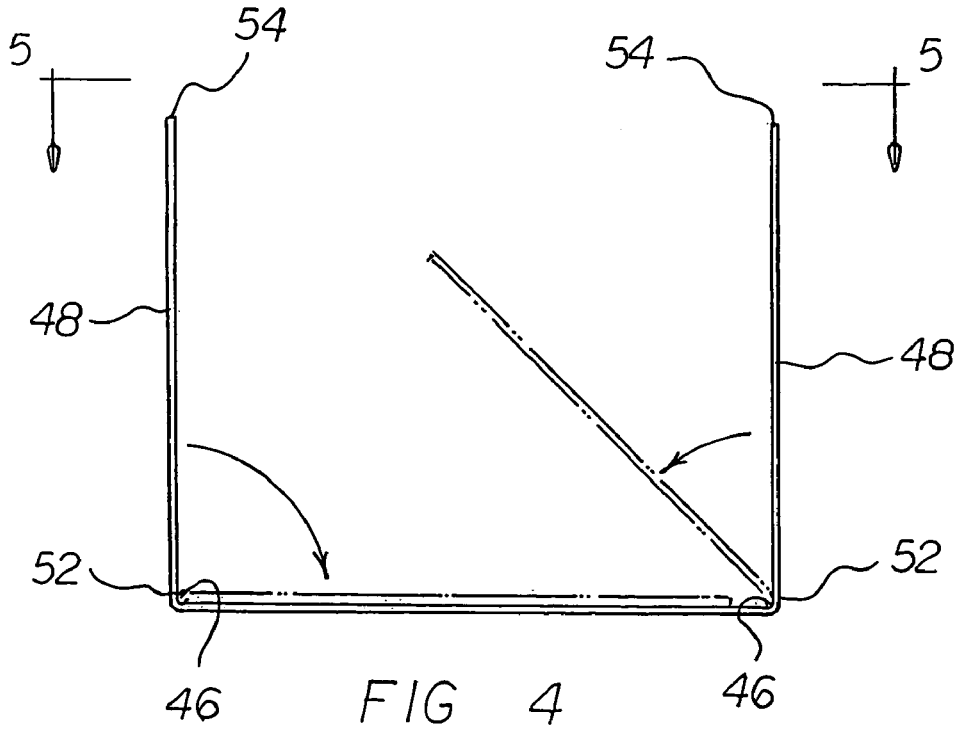
FIG 4

FIG 5
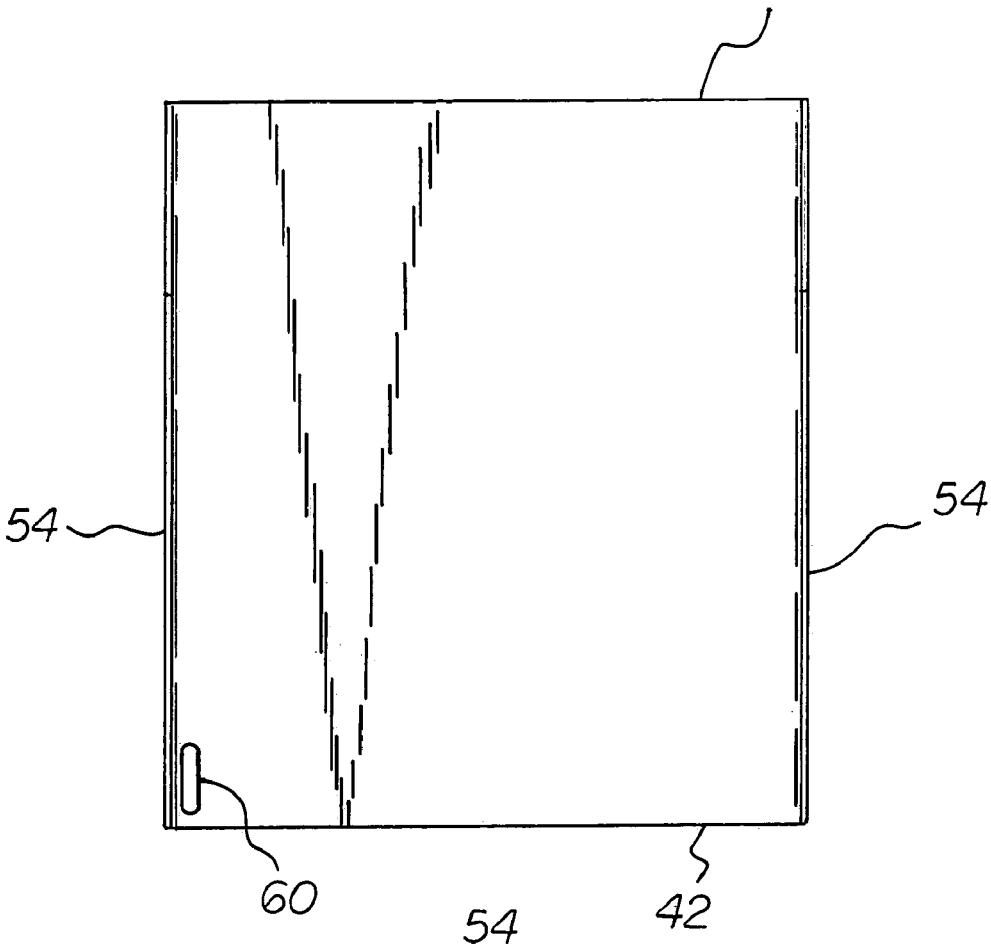
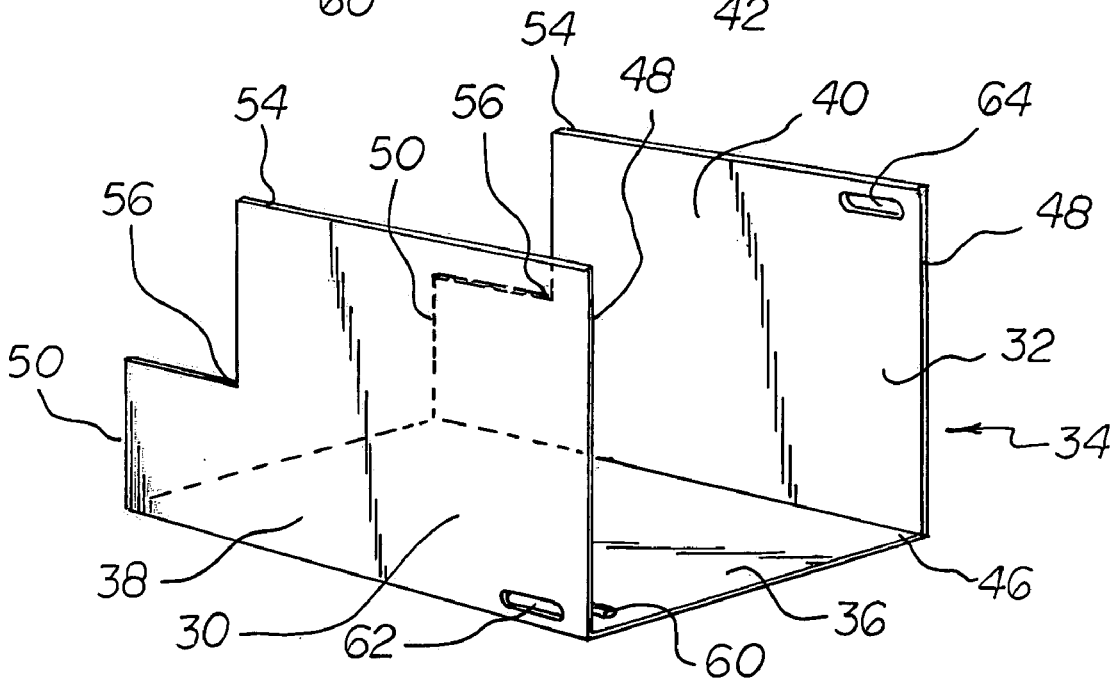
FIG 6

LEAF COLLECTING SYSTEM

BACKGROUND OF THE INVENTION

1. Field of the Invention

The present invention relates to a Leaf collecting system and more particularly pertains to assisting users in moving leaves and other debris into a trash container.

2. Description of the Prior Art

The use of bagging systems of known designs and configurations is known in the prior art. More specifically, bagging systems of known designs and configurations previously devised and utilized for the purpose of assisting users in moving items into a container through known methods and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,749,011 issued Jun. 7, 1988 to Rylander relates to a flexible bag holder. U.S. Pat. No. 4,884,603 issued Dec. 5, 1989 to Simpson relates to a device for holding the mouth of a flexible bag open and method of use. Lastly, U.S. Pat. No. 5,129,609 issued Jul. 14, 1992 to Tobin relates to a flexible trash bag support apparatus.

While these devices fulfill their respective, particular objectives and requirements, the aforementioned patents do not describe leaf collecting system that allows assisting users in moving leaves and other debris into a trash container.

In this respect, the leaf collecting system according to the present invention substantially departs from the conventional concepts and designs of the prior art, and in doing so provides an apparatus primarily developed for the purpose of assisting users in moving leaves and other debris into a trash container.

Therefore, it can be appreciated that there exists a continuing need for a new and improved leaf collecting system which can be used for assisting users in moving leaves and other debris into a trash container. In this regard, the present invention substantially fulfills this need.

SUMMARY OF THE INVENTION

In view of the foregoing disadvantages inherent in the known types of bagging systems of known designs and configurations now present in the prior art, the present invention provides an improved leaf collecting system. As such, the general purpose of the present invention, which will be described subsequently in greater detail, is to provide a new and improved leaf collecting system and method which has all the advantages of the prior art and none of the disadvantages.

To attain this, the present invention essentially comprises a trash container. The trash container comprises an essentially rigid trash can. The trash can has an insertable flexible liner. The trash can may be utilized without a liner and, conversely, the liner may be used without the trash can. The trash can has a generally rectilinear configuration. The trash can has a rectangular closed bottom. The trash can has a parallel rectangular open top. The trash can also has broad side walls and narrow end walls. The narrow end walls are provided between the side walls. The trash container is movable between a storage orientation and an operational orientation. In the storage orientation, the top is provided above the bottom, as shown in solid lines in FIG. 2. In the operational orientation, the top is laterally spaced from the bottom with one broad side wall resting on the ground, as shown in FIG. 1 and as shown in dotted lines in FIG. 2.

A broom is provided. Debris is also provided. The broom is a moving device adapted to push leaves and other debris into the trash container for disposal purposes. Other moving devices include those selected from the class of moving devices including brooms, brushes and rakes.

Further provided is a chute. The chute is fabricated of a resilient, generally rigid plastic material. A relatively stiff card board material is acceptable as an alternative embodiment of the invention. The chute has a central section and two similarly shaped side sections. The side sections are pivotally coupled to the central section. The central section has a rectangular configuration. The central section has a short input edge and a parallel output edge. Longer parallel side edges are provided between the edges. Each side section has an input edge. The input edge is adjacent to and slightly smaller than the input edge of the central section. Each side section has an output edge. The output edge is adjacent to and about half the length of the input edge of the central section. Each side section has an interior edge. The interior edge is pivotally coupled to a side edge of the central section. Each side section has an exterior edge. The exterior edge extends from the front edge of a side section. Each side section has an L-shaped cut out. The L-shaped cut out extends from its output edge toward its input edge and extends from its exterior edge toward its interior edge. The chute is adapted to be held in an open orientation. The side sections are in a spaced parallel configuration. The output ends and L-shaped cut out are provided within the trash container. The remainder of the chute extends outwardly from the trash container. In this manner a user may sweep leaves and other debris onto the central section of the chute between the side sections and into the trash container, as may be seen in FIG. 1. The trash container may then be tipped erect, as shown in solid lines in FIG. 2, and the chute then removed.

Provided last are three similarly configured oval hand holes. The hand holes include a first hand hole. The first hand hole is located in the central section adjacent to the input edge and adjacent to one side section. The hand holes include a second hand hole. The second hand hole is located in the one side section adjacent to the input edge and the central section. The hand holes also include a third hand hole. The third hand hole is located in the other side section adjacent to the input edge and remote from the central section. In this manner the side sections may be folded flat and parallel with the central section with the three hand holes in alignment for carrying purposes when the chute is not in use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved leaf collecting system which has all of the advantages of the prior art bagging systems of known designs and configurations and none of the disadvantages.

It is another object of the present invention to provide a new and improved leaf collecting system which may be easily and efficiently manufactured and marketed.

It is further object of the present invention to provide a new and improved leaf collecting system which is of durable and reliable constructions.

An even further object of the present invention is to provide a new and improved leaf collecting system which is susceptible of a low cost of manufacture with regard to both materials and labor, and which accordingly is then susceptible of low prices of sale to the consuming public, thereby making such leaf collecting system economically available to the buying public.

Even still another object of the present invention is to provide a leaf collecting system for assisting users in moving leaves and other debris into a trash container.

Lastly, it is an object of the present invention to provide a new and improved leaf collecting system. A chute is fabricated of a resilient, generally rigid material. The chute has a central section and two side sections coupled to the central section. The central section and each side section have input edges, output edges and side edges there between. Each side section has a cut out extending from its output edge toward its input edge. The cut out extends inwardly from its exterior edge. The chute is adapted to be held in an open orientation. The side sections are in a spaced configuration. The input ends and L-shaped cut outs within a trash container and the remainder of the chute extend outwardly from the trash container. In this manner a user may sweep leaves and other debris onto the central section of the chute between the side sections and into the trash container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the chute shown in FIGS. 1 and 2.

FIG. 4 is a front elevational view of the chute taken at line 4—4 of FIG. 3.

FIG. 5 is a plan view of the chute taken at line 5—5 of FIG. 4.

FIG. 6 is a perspective view of the chute shown in the prior Figures.

The same reference numerals refer to the same parts throughout the various Figures.

DESCRIPTION OF THE PREFERRED EMBODIMENT

Figure 1:
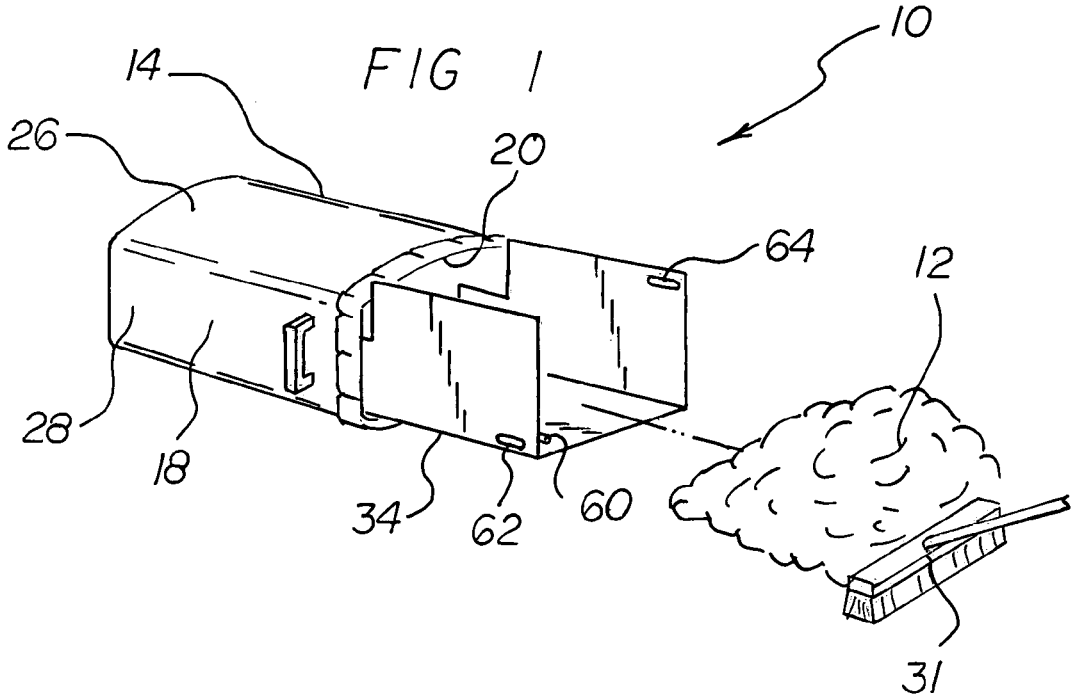
FIG. 1 is a perspective illustration of a leaf collecting system constructed in accordance with the principles of the present invention.

With reference now to the drawings, and in particular to FIG. 1 thereof, the preferred embodiment of the new and improved leaf collecting system embodying the principles and concepts of the present invention and generally designated by the reference numeral 10 will be described.

Figure 2:
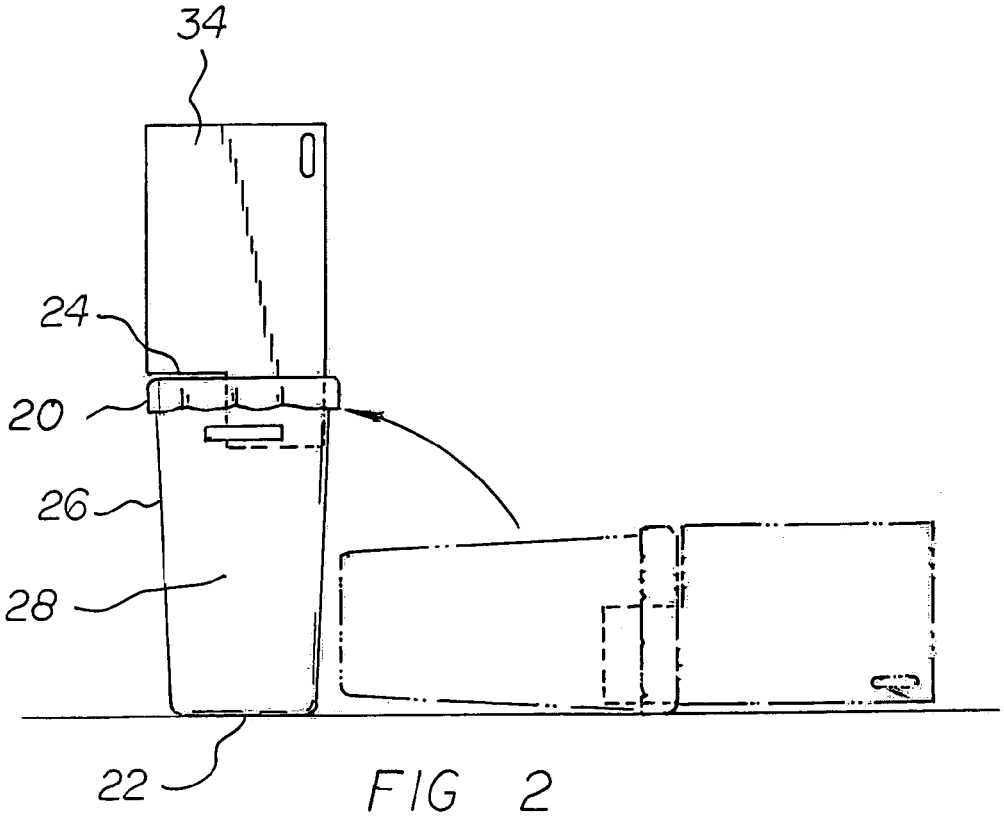
FIG. 2 is a side elevational view of the system shown in FIG. 1 with the components in a vertical orientation and, in a dotted line configuration, in a horizontal orientation.

First provided is a trash container 14. The trash container comprises an essentially rigid trash can 18. The trash can has an insertable flexible liner 20. The trash can may be utilized without a liner and, conversely, the liner may be used without the trash can. The trash can has a generally rectilinear configuration. The trash can has a rectangular closed bottom 22. The trash can has a parallel rectangular open top 24. The trash can also has broad side walls 26 and narrow end walls 28. The narrow end walls are provided between the side walls. The trash container is movable between a storage orientation and an operational orientation. In the storage orientation, the top is provided above the bottom, as shown in solid lines in FIG. 2. In the operational orientation, the top is laterally spaced from the bottom with one broad side wall resting on the ground, as shown in FIG. 1 and as shown in dotted lines in FIG. 2.

A broom 31 is provided. Debris 12 including leaves is also provided. The broom is a moving device adapted to push leaves and other debris into the trash container for disposal purposes. Other moving devices include those selected from the class of moving devices including brooms, brushes and rakes.

Further provided is a chute 34. The chute is fabricated of a resilient, generally rigid plastic material. Any relatively stiff material is acceptable as an alternative embodiment of the invention. The chute has a central section 36 and two similarly shaped side sections 38, 40. The side sections are pivotally coupled to the central section. The central section has a rectangular configuration. The central section has a short input edge 42 and a parallel output edge 44. Longer parallel side edges 46 are provided between the edges. Each side section has an input edge 48. The input edge is adjacent to and slightly smaller than the input edge of the central section. Each side section has an output edge 50. The output edge is adjacent to and about half the length of the output edge of the central section. Each side section has an interior edge 52. The interior edge is pivotally coupled to a side edge of the central section. Each side section has an exterior edge 54. The exterior edge extends from the front edge of a side section. Each side section has an L-shaped cut out 56. The L-shaped cut out extends from its output edge toward its input edge and extends from its exterior edge toward its interior edge. The chute is adapted to be held in an open orientation. The side sections are in a spaced parallel configuration. The output ends and L-shaped cut out are provided within the trash container. The remainder of the chute extends outwardly from the trash container. In this manner a user may sweep leaves and other debris onto the central section of the chute between the side sections and into the trash container, as may be seen in FIG. 1. The trash container may then be tipped erect, as shown in solid lines in FIG. 2, and the chute then removed.

Provided last are three similarly configured oval hand holes 60, 62, 64. The hand holes include a first hand hole 60. The first hand hole is located in the central section adjacent to the input edge and adjacent to one side section 30. The hand holes include a second hand hole 62. The second hand hole is located in the one side section 30 adjacent to the input edge and the central section. The hand holes also include a third hand hole 64. The third hand hole is located in the other side section 32 adjacent to the input edge and remote from the central section. In this manner the side sections may be folded flat and parallel with the central section with the three hand holes in alignment for carrying purposes when the chute is not in use. In an alternate embodiment of the invention, the hinges are eliminated between the central section and side sections of the chute. In place thereof, the material is made from a more flexible plastic material whereby that end of the chute with the L-shaped cut out entering the trash container, may bend and fit within a generally cylindrical trash container with the chute conforming the curvature of the open top of the container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A leaf collecting system for assisting users in moving leaves and other debris into a trash container for disposal comprising, in combination:

a trash container comprising an essentially rigid trash can with an insertable flexible liner, the trash can having a generally rectilinear configuration with a rectangular closed bottom and a parallel rectangular open top and with broad side walls and narrow end walls there between, the trash container being movable between a storage orientation with the top above the bottom and an operational orientation with the top laterally spaced from the bottom with one broad side wall resting on the ground;

a moving device adapted to push leaves and other debris into the trash container for disposal purposes, such moving device selected from the class of moving devices including brooms, brushes and rakes;

a chute fabricated of a resilient, generally rigid plastic material, the chute having a central section and two similarly shaped side sections pivotally coupled to the central section, the central section having a rectangular configuration with a short input edge and a parallel output edge and longer parallel side edges there between, each side section having an input edge adjacent to and slightly smaller than the input edge of the central section, each side section having an output edge adjacent to and about half the length of the output edge of the central section, each side section having an interior edge pivotally coupled to a side edge of the central section, each side section having an exterior edge extending from the front edge of a side section, each side section having an L-shaped cut out extending from its output edge toward its input edge and extending from its exterior edge toward its interior edge, the chute adapted to be held in an open orientation with the side sections in a spaced parallel configuration and the output ends and L-shaped cut out within the trash container and the remainder of the chute extending outwardly from the trash container so that a user may sweep leaves and other debris onto the central section of the chute between the side sections and into the trash container and the trash container may then be tipped erect; and three similarly configured oval hand holes including a first hand hole located in the central section adjacent to the input edge and adjacent to one side section and a second hand hole located in the one side section adjacent to the input edge and the central section and a third hand hole located in the other side section adjacent to the input edge and remote from the central section whereby when the chute is not in use, the side sections may be folded flat and parallel with the central section with the three hand holes in alignment for carrying purposes.

2. A leaf collecting system comprising:

a chute fabricated of a resilient, generally rigid material having a central section and two side sections coupled to the central section, the central section and each side section having input edge and an output edge with side edges there between, each side section having an L-shaped cut out extending from its output edge toward its input edge and extending inwardly from its exterior edge, the chute adapted to be held in an open orientation with the side sections in a spaced configuration and the input ends and L-shaped cut outs within a trash container and the remainder of the chute extending outwardly from the trash container so that a user may sweep leaves and other debris onto the central section of the chute between the side sections and into the trash container; wherein the side sections are pivotally connected to the central section, and further including:

three similarly configured oval hand holes including a first hand hole located in the central section adjacent to the input edge and adjacent to one side section and a second hand hole located in the one side section adjacent to the input edge and the central section and a third hand hole located in the other side section adjacent to the input edge and remote from the central section whereby when the chute is not in use, the side sections may be folded flat and parallel with the central section with the three hand holes in alignment for carrying purposes.

* * * * *